United States Patent [19]

Hillerström et al.

[11] 4,347,972

[45] Sep. 7, 1982

[54] APPARATUS FOR PRODUCTION OF HOT WATER

[75] Inventors: Björn Hillerström, Onsale; Lennarth Fransson; Arne Thuvander, both of Ljungby, all of Sweden

[73] Assignee: AB CTC, Ljungby, Sweden

[21] Appl. No.: 120,911

[22] Filed: Feb. 12, 1980

[30] Foreign Application Priority Data

Feb. 27, 1979 [SE] Sweden ..... 7901726

[51] Int. Cl.[3] ..... F28F 27/00; F24D 3/08

[52] U.S. Cl. ..... 236/18; 237/19; 165/39; 126/362; 126/374

[58] Field of Search ..... 237/19, 8 C, 8 R; 236/18, 19; 165/35, 39; 126/362, 374

[56] References Cited

FOREIGN PATENT DOCUMENTS 1299194 6/1962 France ..... 237/19

*Primary Examiner*—Albert J. Makay
*Assistant Examiner*—Henry Bennett
*Attorney, Agent, or Firm*—Larson and Taylor

[57] ABSTRACT

An apparatus for producing hot water. A heat exchanger has a primary circuit which receives water from a hot water source and delivers the spent water back to the source. A secondary circuit through the heat exchanger receives unheated water and delivers it as hot tap water. A pump is connected in the line between the hot water source and the primary circuit of the heat exchanger, and a shunt bypass is connected in parallel with the series comprising the pump and the primary circuit of the heat exchanger. A sensing means such as a temperature sensing means senses the commencement of water flow through the secondary circuit and in response thereto operates the pump. Another temperature sensing means measures the temperature downstream from the primary circuit and in response thereto controls the distribution of fluid downstream from the primary circuit of the heat exchanger as between the shunt and the return line to the hot water source.

7 Claims, 4 Drawing Figures

APPARATUS FOR PRODUCTION OF HOT WATER

This invention relates to an apparatus for production of tap hot water by heating of cold water, the said apparatus comprising a heat exchanger connected to a tank with hot water. The storage tank may consist of a boiler which can be heated in a prior art manner or of some other liqui storage tank. The said hot water is intended to flow through the primary circuit of the heat exchanger and the cold water is intended to be supplied to the secondary circuit of the heat exchanger.

A heat exchanger of this type is regarded as a throughflow heater, by which is meant a tap water heating system in which the tap hot water is produced as it is to be used. Such systems are previously known but have displayed the disadvantage of not being able to be used when the water contains lime, since a lime deposit in the pipe takes place at high temperatures. In order to avoid this problem, it would be necessary to bring the boiler temperature down to 60°–65° C., but in order for this to be done it would be necessary for the furnace to be made of corrosion-proof material. Moreover, the size of the water storage tank would have to be substantially increased in order to cope with the energy take-off at such lower temperature.

The present invention provides a temperature-controlled through-flow heater which is so arranged that it becomes possible to use the arrangement in areas with calcareous water. In the case of small draw-offs, tap hot water with a temperature of 55°–60° C. is obtained, which is suitable for household use, whereas in the case of larger draw-offs, so-called bath tub draw-offs, the temperature will be at a somewhat lower level. The arrangement is also distinguished by its compact dimensions, particularly in comparison with storage-type hot water heaters. Moreover, the requisite volume of liquid in the storage tank (the boiler) is substantially reduced in comparison with what is required in the case of draw-off batteries used heretofore.

Also eliminated by the invention is the need for a mixing valve on the tap hot water side, which in other systems and according to current standards is usually required in order for the temperature of the tap hot water not to exceed 60°–65° C.

Figure 1:
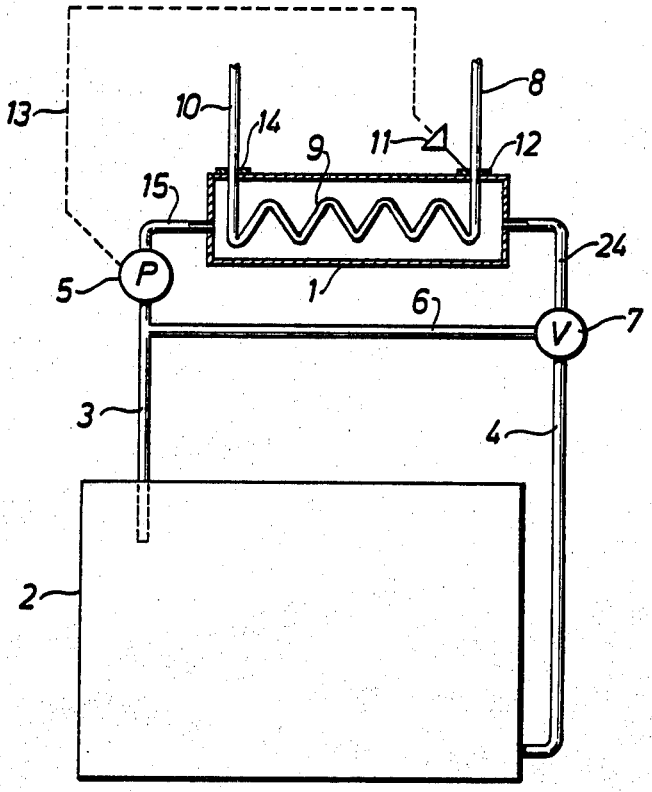
Figure 2:
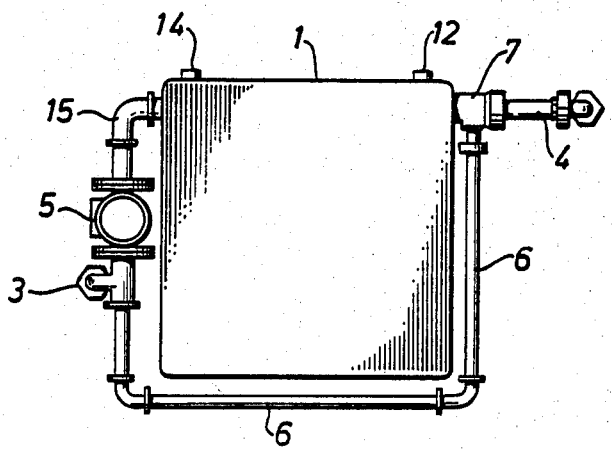
Figure 3:
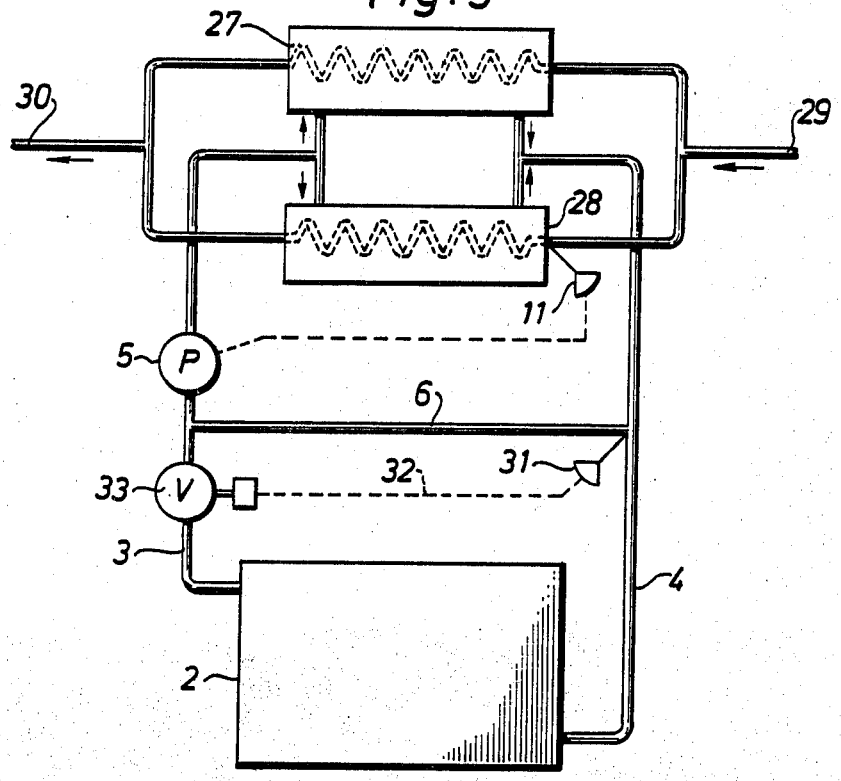
Figure 4:
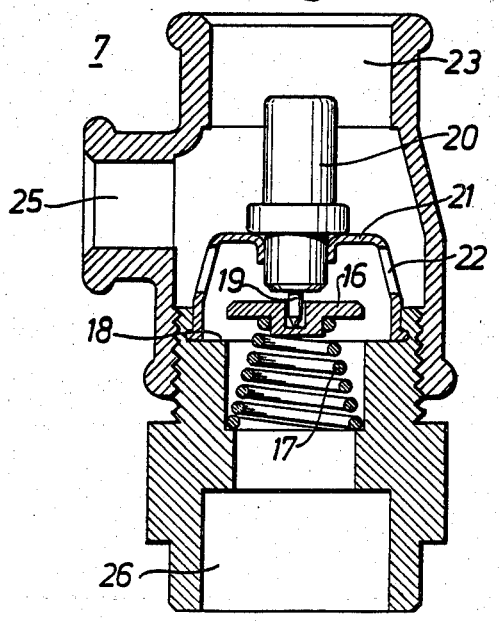

Further advantages of the invention are evident from the embodiments of the invention described below with reference to the accompanying drawings, wherein:

FIG. 1 shows schematically an arrangement with a heat exchanger which is connected to a boiler, FIG. 2 shows the heat exchanger with associated connections viewed from above, FIG. 3 shown another embodiment having two heat exchangers, and FIG. 4 is a sectional view taken through a thermostat-controlled valve included in the arrangement.

In the embodiment according to FIG. 1, a heat exchanger 1 is connected to a storage tank 2, which may be a boiler, through a supply line 3 and return line 4. Through these lines, the boiled water from the boiler 2 can be made to circulate through the primary circuit in the heat exchanger 1. To promote circulation, a circulation pump 5 is connected in series with the primary circuit of the heat exchanger. The series connection of the heat exchanger and circulation pump is connected in parallel with a shunt line 6, the inlet end to the shunt line being connected to the return line 4 by means of a thermostat-controlled regulating valve 7 which will be described in greater detail below. The cold water which is to be heated is supplied through a line 8 to the secondary circuit 9 of the heat exchanger and leaves the heat exchanger as tap hot water through a line 10. A check valve may be installed in line 3 or 4.

A thermostat is installed in thermic contact with a connection 12, through which the cold water is supplied through the line 8 to the secondary circuit of the heat exchanger. This thermostat 11 is, as indicated by the broken line 13, arranged to control engagement and disengagement of the circulation pump 5 and thus of the supply of hot water from the boiler 2 to the primary circuit in the heat exchanger 1.

Shown in FIG. 2 is the heat exchanger 1 viewed from above. It is appropriately arranged as an essentially flat box containing a bundle of tubes which is connected bwtween the previously mentioned connection 12 and a connection 14 which is connected with the line 10 for tap hot water. The bundle of tubes is arranged to be surrounded by ater in the primary circuit which is supplied through a line 15. Line 15 communicates with the circulation pump 5 which in turn communicates with the supply line 3 and the shunt line 6. The circulation pump may also be situated between the regulating valve 7 and the heat exchanger 1. As in the arrangement according to FIG. 1, a thermostat-controlled regulating valve 7 is installed at the connection point between the shunt line 6 and the return line 4.

The regulating valve 7 causes a distribution of the flow through the shunt line 6 on the one hand and the line 4, the storage tank 2 and the line 3 on the other hand such that the temperature of the heat transmission surfaces on the secondary side of the heat exchanger does not attain such a high level that precipitation of lime occurs. This result is achieved by means of temperature-controlled distribution to the shunt line 6 and the return line 4 of the flow which is supplied from the primary circuit in the heat exchanger 1 to the regulating valve 7.

A suitable design of the regulating valve 7 is shown in FIG. 4. The valve contains a valve body 16, which by means of a spring 17 is kept lifted up from a valve seat 18. Against the action of the spring 17, the valve body 16 can be pressed against the valve seat 18 by an operating pin 19 in a thermostat element 20. This element 20 is held in a yokelike retainer 21, which is provided with a number of holes 22 distributed around its circumference. The inlet 23 to the valve 7 is connected with the line 24 shown in FIG. 1 from the primary circuit of the heat exchanger to the valve 7. One outlet 25 is connected to the shunt line 6 and the other outlet 26 to the return line 4 to the boiler 2. Under the influence of the spring 17, the valve body 16 is, in its rest position, raised from the valve seat 18, but if the temperature of the water surrounding the thermostat element 20 exceeds a predetermined value, the operating pin 19 is pushed out far enough so that the valve body 16 engages the valve seat 18 and thus closes the connection from the inlet 23 to the outlet 26. The connection between the inlet 23 and the outlet 25 connected with the shunt line 6 is, however, always open.

In order to be completely certain that the flow through the boiler 2 goes from the return line 4 to the supply line 3 a check valve, not shown in the drawings, can be fitted in either of these lines. In an appropriate embodiment, such a valve can be arranged inside the lower section of the valve 7 which forms the outlet 26.

The arrangement described herein functions in the following manner. When no drawing of hot water from the line 10 occurs, the circulation pump 5 is at rest and the heat exchanger does not exceed the temperature at which a risk for precipitation of lime exists. When draw-off of hot water commences, the thermostat 11, which is in thermic contact with the inlet 12, is cooled. This causes the circulation pump 5 to be started so that water from the boiler 2 is supplied through the supply lines 3 and 15 to the primary side of the heat exchanger. A corresponding amount of water is returned via the valve 7 and return line 4 to the boiler 2. The thermostat element 20 in the valve 7 is surrounded by the incoming water and it adjusts itself to a predetermined temperature level. When draw-off through the line 10 ceases, this pre-determined temperature level at element 20 is exceeded and the valve 7 closes the connection with the outlet 26 so that the circulating water is completely returned to the circulation pump 5 through the shunt line 6, and temperature equalization ocurs in the heat exchanger, whereupon the thermostat 11 stops the pump 5.

It is evident from the above functional description that the circulation pump is, largely speaking, only running when drawing of hot water is actually taking place so that the supplied cold water actuates the thermostat 11. In addition, the regulating valve 7 in combination with the shunt line 6 assures that the temperature in the heat exchanger 1 cannot be so high as to risk precipitation of lime. The temperature of the obtained hot water moreover, will be set at suitable values in that the temperature will be higher in the case of relatively small draw-offs which can occur in connection with laundering or dish washing. The temperature, in contrast, will be somewhat lower when larger quantities are drawn off, for instance for a bath or shower. This implies in turn that the boiler energy in the hot water storage tank can be utilized more efficiently than in the case of previously known draw-off batteries or storage heaters. For a given hot water requirement, the water volume of the boiler can thus be substantially reduced. The regulating valve 7 incorporated in the arrangement, despite its simple and inexpensive design, gives a satisfactorily high flow rate for the water around the thermostat element 20, whereby a good and rapid regulation is obtained for all quantities of hot water draw-off. Since the thermostat 11 is situated in thermic contact with the connection 12, through which cold water is supplied, extremely good functioning is obtained in that the circulation pump 5 starts very rapidly upon commencement of draw-offs of hot water and stops when equalization has occured in the heat exchanger after termination of draw-off.

In an alternative embodiment of the invention shown in FIG. 3, two heat exchangers 27 and 28 are utilized which relative to each other are connected in parallel on the primary side and on the secondary side. The cold water is supplied through a connection 29 and can leave the heat exchangers 27 and 28 as hot water through a connection 30. In this embodiment, the heat exchanger 28 is equipped with a thermostat 11 which, in the same way as in the arrangement according to FIG. 1, controls the circulation pump 5. The arrangement also features a shunt line 6, but has no direct counterpart to the regulating valve 7. Instead, a second thermostat 31 is provided at a corresponding connection point between the shunt line 6 and the return line 4. This second thermostat 31 controls, as indicated with the broken lines 32, a valve 33 which is installed in the supply line 3 from the boiler 2. As long as no draw-off occurs, this valve is closed. When drawing-off of hot water commences, the thermostat 11 reacts and starts the circulation pump 5. The thermostat valve 33 releases a requisite amount of hot water through the supply line 3 so that the cold water supplied through the connection 29 can be heated in the heat exchangers 27 and 28. By this means, the temperature in the heat exchangers is unable to exceed the level at which a risk for precipitation of lime exists.

When drawing off through line 30 ceases, the predetermined temperature level is exceeded, the thermostat valve 33 closes and temperature equalization occurs in the heat exchangers 27 and 28, whereupon the thermostat 11 stops the pump 5.

We claim:

1. An apparatus for producing hot water, comprising:

a heat exchanger, a source of hot water connected to the primary circuit of said heat exchanger for flowing hot water therethrough, and a return line for returning fluid from the primary circuit back to the source of hot water, pipe means defining a secondary fluid circuit through the heat exchanger such that the fluid in the secondary circuit is in heat exchange relationship with the fluid of the primary circuit, said secondary fluid circuit including means for receiving unheated water and delivering the same as heated water, a pump in the line between the source and the primary circuit of the heat exchanger, a shunt passage in parallel with the line which includes the pump and the primary circuit of the heat exchanger, such that fluid downstream from the primary circuit of the heat exchanger can be delivered directly to the pump, bypassing the said source, and a temperature sensitive device for sensing a drop in temperature of the water in the secondary circuit adjacent to and in heat exchange relationship to the primary circuit, upon commencement of flow through the secondary circuit, to control operation of said pump for causing a flow of water from the said source to the said primary circuit of the heat exchanger and for terminating such flow through the primary circuit upon termination of flow through the secondary circuit.

2. An apparatus according to claim 1, including a second temperature sensing device for sensing the temperature downstream from the primary circuit, a valve means operable in response to said second temperature sensing device for controlling the distribution of fluid flow downstream from the primary circuit as between the said shunt on the one hand and a return line back to the said hot water source on the other hand.

3. An apparatus according to claim 2, said second temperature sensing device and said valve means formed as a unit at the junction of said return line and said shunt, said unit having a constantly open passage from the primary circuit to the shunt and a valve element adapted to partially or completely close the valve opening to the return line in response to the temperature sensed by the second temperature sensing device.

4. An apparatus according to claim 3, including means for resiliently urging the valve element to an open position, the second temperature sensing device comprising a member acting on the valve element in opposition to the spring, the degree of movement of the valve element towards its closed position being responsive to the temperature of the fluid leaving the primary circuit as sensed by the second temperature sensing device.

5. An apparatus according to claim 2, said valve means being located between the hot water source and the intersection of the shunt with the line leading to the said pump.

6. An apparatus according to claim 5, said second temperature sensing device positioned to sense the temperature at the junction of the return line and the shunt.

7. An apparatus according to any one of claims 1, 2–6, wherein the heat exchanger comprises a pair of primary circuits connected in parallel with each other between the pump and the junction of the return line and the shunt, and a separate secondary circuit passing through each of said primary circuits.

* * * * *